United States Patent [19]

Bartz

[11] 3,988,854

[45] Nov. 2, 1976

[54] STACKABLE ELEMENTS WITH LATERAL CONNECTOR

[76] Inventor: Richard O. Bartz, 7017 Mark Terrace Drive, Edina, Minn. 55435

[22] Filed: Jan. 20, 1975

[21] Appl. No.: 542,522

Related U.S. Application Data

[63] Continuation-in-part of Ser. No. 385,090, Aug. 2, 1973, Pat. No. D237,068.

[52] U.S. Cl. ..... 46/26

[51] Int. Cl.[2] ..... A63H 33/10

[58] Field of Search ..... 46/25, 26

[56] References Cited

UNITED STATES PATENTS

| | | | |
|---|---|---|---|
| 2,786,301 | 3/1957 | Torricelli | 46/25 X |
| 3,340,781 | 9/1967 | See | 46/25 X |
| 3,415,007 | 12/1968 | Howe | 46/25 X |
| 3,636,230 | 1/1972 | Jacey | 46/26 X |
| 3,701,214 | 10/1972 | Sakamoto | 46/26 X |
| 3,720,015 | 3/1973 | Van de Veken | 46/25 X |
| 3,882,630 | 5/1975 | Bianco | 46/26 X |

FOREIGN PATENTS OR APPLICATIONS

| | | | |
|---|---|---|---|
| 184,497 | 1/1956 | Austria | 46/26 |

*Primary Examiner*—F. Barry Shay

*Attorney, Agent, or Firm*—Burd, Braddock & Bartz

[57] ABSTRACT

A construction member having a tubular body with side walls surrounding a passage through the body. Each side wall has an opening and a plurality of notches for accommodating a connecting element. The side walls have a longitudinally projected flange of a size that fits into a passage of another construction member so that a plurality of construction members can be connected together. The body can have a square, triangular, and other multiside shapes.

6 Claims, 9 Drawing Figures

STACKABLE ELEMENTS WITH LATERAL CONNECTOR

CROSS REFERENCE TO RELATED APPLICATION

This application is a continuation-in-part of U.S. application Ser. No. 385,090 filed Aug. 2, 1973 now U.S. Pat. No. D237,068.

BACKGROUND OF THE INVENTION

Objects and equipment that can be touched and manipulated are used to enrich the human environment for learning and to provide exercise and therapeutic treatment. These objects stimulate curiosity and creativity as well as develop personal confidence and enthusiasm. Good educational objects must be sturdy and durable to provide a permissive atmosphere where a person can exercise his need to touch and feel and even throw, pull and pound.

All children need early physical experiences with shape and weight of objects. Educational and therapeutic experiences with objects require much handling and doing with the objects. To build a whole out of parts is a challenging activity. Finding the parts that provide a maximum number of settings or the largest size of a structure that does not topple is a challenging and rewarding experience. Examples of the objects currently available are the snap together beads, rods and connectors, construction sets, and interlocking logs and bricks. Construction structures are shown in U.S. Pat. Nos. D208,789 and D225,016 and U.S. Pat. Nos. 1,883,214; 3,553,882; and 3,604,130.

SUMMARY OF INVENTION

The invention is related to a construction member or object used to form symmetrical and asymmetrical structural designs. The construction member has a tubular body provided with a plurality of side sections. The side sections are joined together to form a continuous wall surrounding a passage through the body. At least one of the side sections has an opening surrounded by an inner edge. A plurality of outwardly directed notches interrupt the inner edge. The notches are arranged in opposing pairs to receive a connecting member. The side sections have flange means extended in the longitudinal direction of the side sections. The flange means is of a size and shape to fit into the passage of another construction member whereby the construction members can be interconnected and stacked on each other. The tubular body has a circuitous shape with generally flat sides. The shape can be square, triangular, hexagonal, oval, octagonal, pentagonal or like annular shapes.

An object of the invention is to provide a construction member that is durable and safe in use for children. A further object of the invention is to provide a construction member that can develop eye and hand coordination and manual skills and craftsmanship. Another object of the invention is to provide interconnecting construction members used to provide experience with space and designs and that can be managed well with small hands. Another object of the invention is to provide interconnecting construction members that can be mastered early and will continue to be used as skill and interest develop. Yet another object of the invention is to provide interlocking construction members usable to form symmetrical and asymmetrical structural designs. A further object of the invention is to provide a construction member that is easy to manufacture and is relatively low cost and is reliable in use.

DESCRIPTION OF PREFERRED EMBODIMENTS

Referring to FIGS. 1–5, there is shown the construction member of the invention indicated generally at 20. Member 20 is usable as a therapeutic, educational and toy member to develop eye and hand coordination as well as manual skill and craftsmanship. Member 20 provides the user with experience in space and design that utilizes the creativity and imagination of the user. Member 20 is usable by relatively young children as it can be mastered early and is continued in use as skill and interest develop.

Construction member 20 has a tubular body 21 having generally flat side walls 22, 23, 24 and 25. The side walls 22–25 are integral with each other to form a generally square member having a passage 26 extended from the top to the bottom of the body.

Figure 2:
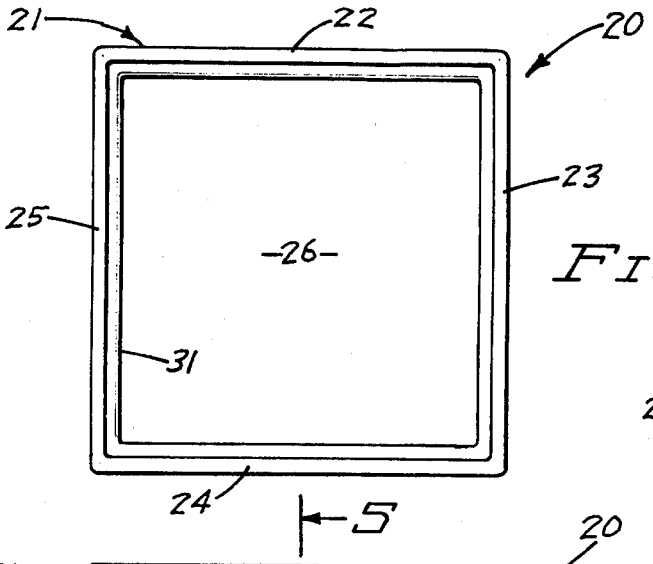
FIG. 2 is a top plan view of FIG. 1.
Figure 5:
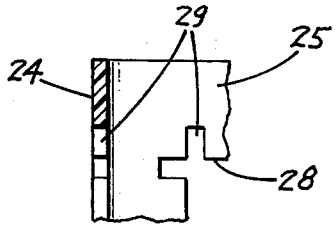
FIG. 5 is an enlarged sectional view taken along the line 5—5 of FIG. 1.
Figure 1:
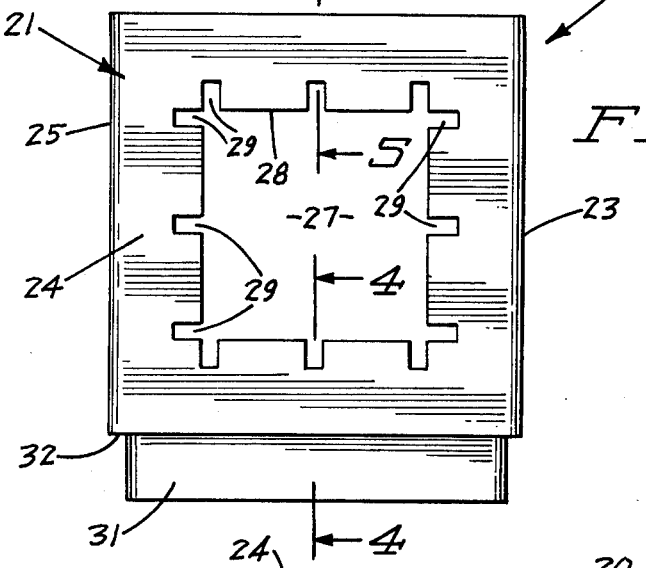
FIG. 1 is a side elevational view of the construction member of the invention.

Referring to FIG. 1, the side wall 24 has a square opening 27 in the center portion thereof. Opening 27 is defined by horizontal and vertical edges 28. The edges 28 are interrupted with notches 29. The notches 29 are open to the opening 27 and are arranged as opposing pairs of notches. The notches 29 have a generally rectangular shape and are located in the corners of opening 27 and midway between the corners of the opening 27. Notches 29 have a width about the same as the thickness of the side wall 24. Twelve notches 29 are shown in the wall 24 of FIG. 1. The number of notches can be changed. For example, the corner openings can be eliminated whereby there would be four notches in the edge 28. Other arrangements of the notches can be made whereby the notches will be in opposing pairs to accommodate a connecting member.

Side walls 22, 23 and 25 have central openings and notches identical to opening 27 and notches 29. Alternatively, only side wall 22 may be provided with a central opening and notches similar to opening 27 and notches 29. Alternatively, side walls 22, 23 and 25 can be solid without openings or notches.

Figure 4:
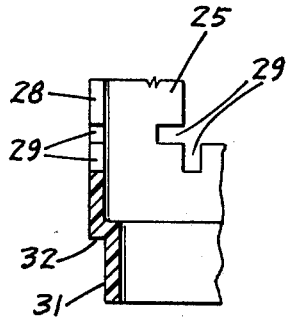
FIG. 4 is an enlarged sectional view taken along the line 4—4 of FIG. 1.
Figure 3:
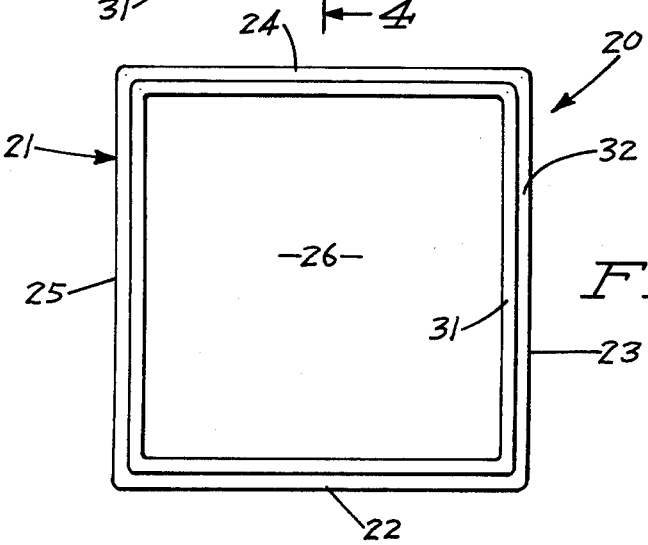
FIG. 3 is a bottom plan view of FIG. 1.

As shown in FIGS. 1, 3 and 4, a flat flange 31 extended in the longitudinal direction of the side walls 22–25 is integral with the bottom of the side walls 22–25. The flange 31 is located inwardly of the outside surface of the side walls and is surrounded by an outwardly directed step or shoulder 32. The outside transverse dimension of the flange 31 is about the same as the inside transverse dimension of the top of the body 21 as shown in FIG. 1. Flange 31 has a flat outside surface having a length so that it is in light friction engagement with the inside wall of body 21. The friction forces between the flange and body of another member hold the two members together.

An example of the construction member 20 is as follows. The tubular body 21 is a square cross section with the side walls having a length of 7 cm. The height of the side wall is 7 cm. The flange has a width of 1 cm. and a length of 6.5 cm. The side walls have a thickness of 0.25 cm. Opening 27 is a square having a dimension of 4 cm. Notches 29 have a depth of 1.5 cm. and a width of 0.25 cm. The entire block is a one-piece member made of flexible polyethylene. Other plastic materials, metals, wood materials, and like materials can be used to make the construction member.

Figure 6:
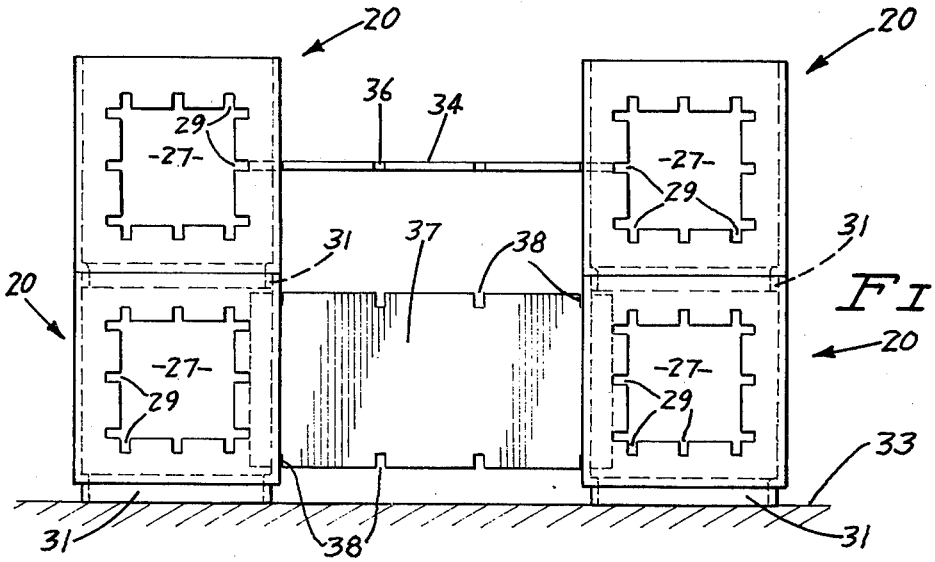
FIG. 6 is a side elevational view of a plurality of interlocked construction members, illustrating an example of the use of the construction members.

Referring to FIG. 6, there is shown a plurality of construction members 20 supported on a support surface 33. Members 20 are identical in structure, with two left members located in an end-to-end stacked relation. In a similar manner, the two right-hand construction members 20 are located in an end-to-end stacked relation. A first connecting plate 34 extends between the top members 20. The connecting plate 34 has notches 36 which cooperate with notches 29 in the member 20 to interconnect the top members 20. In a similar manner, the bottom members 20 are connected with a plate 37 having a plurality of notches 38. The end notches 38 are connected to the top and bottom notches 29 in the facing sides of bottom members 20 to interlock these members. Plate member 34 is located in a generally horizontal plane. Plate member 37 is located in a generally vertical plane.

The structural design shown in FIG. 6 is but one example of the means used to interconnect the construction members. Other connecting members can be used for this purpose. For example, the connecting members shown in U.S. Pat. Nos. D236,221 and D236,223, can be used to interconnect the members 20.

When members 20 are located in a stacked end-to-end relationship, the flange 31 fits into the top of the lower member. The outside surface of flange 31 is in light frictional engagement with the inside surfaces of the side walls 22–25 to thereby hold the adjacent members in an interlocking relationship.

Figure 8:
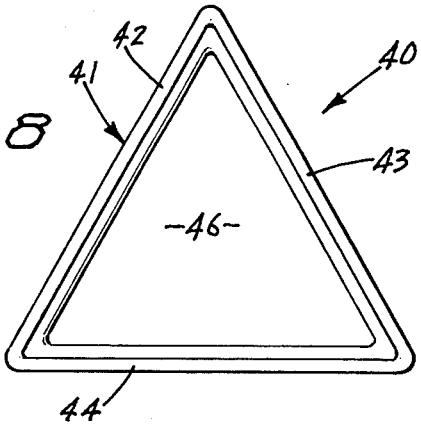
FIG. 8 is a top plan view of FIG. 7.
Figure 9:
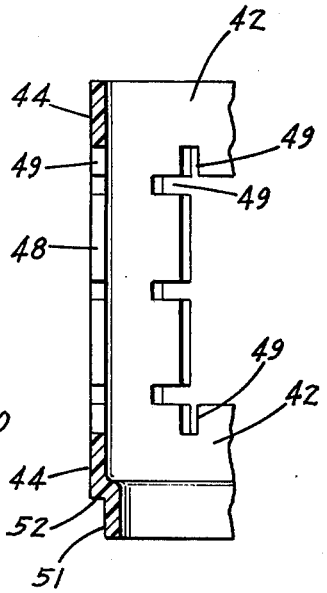
FIG. 9 is an enlarged sectional view taken along the line 9—9 of FIG. 7.
Figure 7:
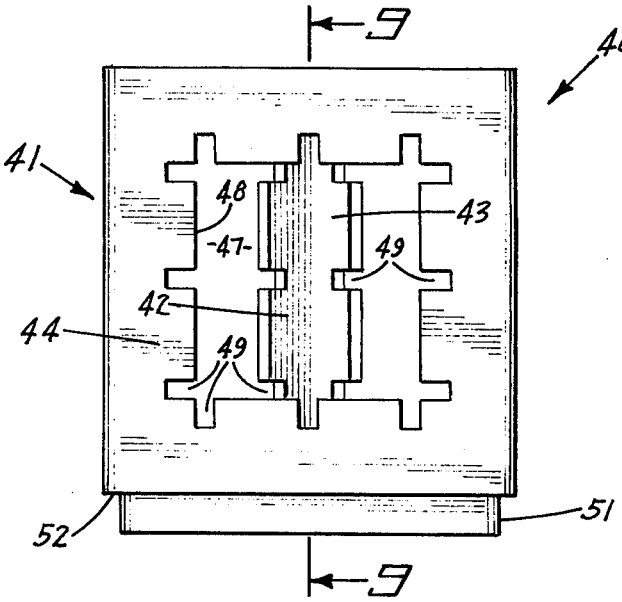
FIG. 7 is a side elevational view of a modification of the construction member of the invention.

Referring to FIGS. 7–9, there is shown a modification of the construction member of the invention indicated generally at 40. Construction member 40 has a tubular body 41 having three sides 42, 43 and 44 forming a generally triangular configuration. A passage 46 extends through the body.

As shown in FIG. 7, side wall 44 has a square opening 47 defined by inside edges 48. A plurality of notches 49 interrupt edge 48. Nothces 49 are arranged in opposite pairs and are open to opening 47. The arrangement of the notches 49 are identical with notches 29 as shown in FIG. 1. As shown in FIGS. 7 and 9, the side walls 42–44 have downwardly directed flange 51 secured to the lower edge of the side wall. Flange 51 extends in the longitudinal direction of side walls 42,43 and 44 and is located inwardly from the outer surface of the side walls. An annular stop shoulder or step 52 is located between flange 51 and the outside of the side walls 42, 43 and 44. Flange 51 and step 52 extend in a triangular pattern around the bottom of the body 41. Flange 51 is adapted to fit into the top of a second construction member 40 so that the plurality of construction members can be interconnected in an end-to-end stacked relationship similar to the construction members 20 shown in FIG. 6. The triangular construction of body 41 can be a right angle triangle with a dimension such that two construction members 40 can be inserted into the top end of construction member 20.

Side walls 42 and 43 have openings 47 to accommodate connecting plates similar to plates 34 and 37 as shown in FIG. 6. Alternatively, the side walls 42 and 43 can be solid without openings.

While there have been shown and described preferred embodiments of the construction members of the invention, it is understood that changes in the size and shape, as well as the use of different materials, can be made by those skilled in the art without departing from the invention.

The embodiments of the invention in which an exclusive property or privilege is claimed are defined as follows:

1. An assembly of construction members comprising: a plurality of construction members, each construction member including a tubular body having a plurality of side walls joined together to form a continuous wall surrounding a passage through the body, said side walls having inside surfaces surrounding an open end of the body, at least two of said side walls each having a generally square opening completely surrounded by inner edges of said one side wall open to the passage, said inner edges having a first pair of laterally spaced and parallel edges and a second pair of laterally spaced and parallel edges, said second pair of edges being extended between and normal to said first pair of edges, a plurality of inwardly directed rectangular notches open to said opening in said first pair of edges and said second pair of edges, said notches being arranged in at least two opposing pairs having facing open ends in each pair of edges, flange means attached to and extended in the longitudinal direction from one end of the side walls, said flange means comprising a flat flange joined to each side wall and extended parallel to the side wall and longitudinally away from the side wall, each flange located inwardly of the plane of the side wall adjacent to the flange and having an outside flat surface adapted to be located in flat surface contact with the inside surface of the side wall of an identical construction member whereby the construction members can be interconnected together along the longitudinal axis of the interconnected construction members, and a connecting member releasably connectable to a pair of said construction members, said connecting member comprising a flat member having outwardly directed rectangular notches arranged in opposing pairs of notches adapted to fit into a desired one of said opposing pairs of notches in the first and second pairs of edges.

2. The assembly of claim 1 wherein: each side wall has a generally square opening completely surrounded by an inner edge of the side wall, each inner edge having a first pair of laterally spaced and parallel edges and a second pair of laterally spaced and parallel edges, said second pair of edges being extended between and normal to said first pair of edges, a plurality of pairs of opposed rectangular notches in said first and second pair of edges, each pair of notches having facing open ends to receive a connecting member.

3. The assembly of claim 1 wherein: each said body has a square shape with four side walls, an open top, an open bottom forming said passage through the body, and said flange means being of a size and shape to fit into the open top construction of another member identical to the defined member whereby the construction members are interconnected.

4. The assembly of claim 3 wherein: each side wall has a generally square opening completely surrounded by an inner edge of the wall, said inner edge having a first pair of laterally spaced and parallel edges and a second pair of laterally spaced and parallel edges, said second pair of edges being extended between and normal to said first pair of edges, a plurality of pairs of opposed rectangular notches in said first and second pair of edges, each pair of notches having facing open ends to receive the connecting member.

5. The assembly of claim 1 wherein: the body has a triangular shape with three generally square side walls forming the sides of a triangle, said flange means being of a size and shape to fit into the passage of another triangular shaped member identical to the defined member.

6. The assembly of claim 5 wherein: each side wall has a generally square opening surrounded by inner edges, each of said inner edges having a first pair of laterally spaced and parallel edges and a second pair of laterally spaced and parallel edges, said second pair of edges being extended between and normal to said first pair of edges, outwardly directed rectangular notches in said first and second pair of edges, said notches being arranged in opposing pairs of notches to receive the connecting member.

* * * * *